US011468806B2

(12) United States Patent
Ijima

(10) Patent No.: US 11,468,806 B2
(45) Date of Patent: Oct. 11, 2022

(54) DRIVER IC AND LIQUID CRYSTAL DISPLAY APPARATUS

(71) Applicant: Mitsubishi Electric Corporation, Tokyo (JP)

(72) Inventor: Yukio Ijima, Tokyo (JP)

(73) Assignee: Trivale Technologies, Santa Clara, CA (US)

( * ) Notice: Subject to any disclaimer, the term of this patent is extended or adjusted under 35 U.S.C. 154(b) by 467 days.

(21) Appl. No.: 15/474,573

(22) Filed: Mar. 30, 2017

(65) Prior Publication Data

US 2017/0287374 A1 Oct. 5, 2017

(30) Foreign Application Priority Data

Apr. 1, 2016 (JP) ..... JP2016-074012

(51) Int. Cl.
*G09G 3/00* (2006.01)
*G09G 3/36* (2006.01)

(52) U.S. Cl.
CPC ..... *G09G 3/006* (2013.01); *G09G 3/3688* (2013.01); *G09G 3/3696* (2013.01); *G09G 2310/027* (2013.01); *G09G 2310/0291* (2013.01); *G09G 2330/12* (2013.01)

(58) Field of Classification Search
None
See application file for complete search history.

(56) References Cited

U.S. PATENT DOCUMENTS 5,859,627 A 1/1999 Hoshiya et al.
6,816,143 B1 * 11/2004 Lambert ..... G09G 3/3688 345/100
10,199,005 B2 * 2/2019 Kong ..... G09G 3/3607
2002/0005722 A1 * 1/2002 Morita ..... G09G 3/006 324/523
2005/0024971 A1 * 2/2005 Lambert ..... G06T 9/007 365/222
2006/0214898 A1 * 9/2006 Woo ..... G09G 3/3688 345/90
2009/0015572 A1 * 1/2009 Matsui ..... G09G 3/3688 345/204

(Continued)

FOREIGN PATENT DOCUMENTS

JP 60-047298 A 3/1985
JP 06-324651 A 11/1994

(Continued)

*Primary Examiner* — Benjamin X Casarez
(74) *Attorney, Agent, or Firm* — Studebaker & Brackett PC

(57) ABSTRACT

An object of the present invention is to provide a driver IC and a liquid crystal display apparatus which uses a circuit of an output channel which is not used to drive a liquid crystal panel as a backup of the other output channel. A driver IC includes a plurality of output channels ch1 to chn, a plurality of output buffer circuits corresponding to each of the plurality of output channels ch1 to chn, and an output channel selection circuit, and when a malfunction occurs in the output buffer circuit of an effective channel, the output buffer circuit in which the malfunction occurs is automatically switched to the output buffer circuit of an ineffective channel so that the output of the signal from the effective channel is continued.

11 Claims, 9 Drawing Sheets

(56) References Cited

U.S. PATENT DOCUMENTS

| | | | | |
|---|---|---|---|---|
| 2010/0225635 | A1* | 9/2010 | Murahashi | G09G 3/006 345/213 |
| 2011/0199355 | A1* | 8/2011 | Watanabe | G09G 3/3688 345/211 |
| 2011/0254822 | A1* | 10/2011 | Anzai | G09G 3/006 345/211 |
| 2012/0306826 | A1* | 12/2012 | Tsuchi | G09G 3/006 345/204 |
| 2014/0043375 | A1* | 2/2014 | Hu | G09G 3/36 345/690 |
| 2015/0124006 | A1* | 5/2015 | Ura | G09G 3/3688 345/690 |
| 2016/0035308 | A1* | 2/2016 | Ota | G09G 3/3688 345/211 |
| 2017/0213518 | A1* | 7/2017 | Tashiro | G09G 3/3648 |

FOREIGN PATENT DOCUMENTS

| | | | |
|---|---|---|---|
| JP | 2005-077527 | A | 3/2005 |
| JP | 2010-078869 | A | 4/2010 |
| JP | 2010-078870 | A | 4/2010 |
| JP | 2010-081255 | A | 4/2010 |
| JP | 2010-122513 | A | 6/2010 |

* cited by examiner

DRIVER IC AND LIQUID CRYSTAL DISPLAY APPARATUS

TECHNICAL FIELD

The present invention relates to a driver IC and a liquid crystal display apparatus.

BACKGROUND ART

A source driver IC (referred to simply as a driver IC hereinafter) is used to apply voltage to each of a plurality of source signal lines of a liquid crystal display panel and drive a source electrode of each pixel. The driver IC includes a plurality of output channels (for example, 1440 ch).

A development of the driver IC having an output channel switching function is accelerated in accordance with an increased resolution of the liquid crystal display panel, and a further extension of an application range of the driver IC such as for vehicle or consumer use is continuously expected. Herein, the output channel switching function means a function of switching a total number of output channels to be used in accordance with a total number of the source signal lines of the liquid crystal display panel.

For example, the number of output channels can be switched among 1440 ch, 1280 ch, 1024 ch, and 960 ch in the driver IC. When the number of channels of the liquid crystal display panel is 1024 ch, the driver IC selects 1024 ch using the output channel switching function.

For example, Japanese Patent Application Laid-Open No. 2005-77527 discloses a technique of selecting a connection and disconnection of the signal line per C unit between the liquid crystal display panel and the driver IC.

SUMMARY OF THE INVENTION

Problems to be Solved by the Invention

Conventionally, when the part of the output channels are selected from among the output channels of the driver IC by the output channel switching function and used to drive the liquid crystal display panel, the output channel which is not selected does not function. When a malfunction occurs in the output channel of the driver IC, a backup operation on the output channel in which the malfunction occurs is required.

An object of the present invention is to provide a driver IC and a liquid crystal display apparatus which uses a circuit of an output channel which is not used to drive a liquid crystal panel as a backup at time of occurrence of malfunction in a circuit of the other output channel.

Means For Solving the Problems

The driver IC 11 according to the present invention includes a plurality of output channels outputting signals to each of a plurality of row wirings or plurality of column wirings in a liquid crystal display panel, a plurality of output buffer circuits corresponding to each of the plurality of output channels, and an output channel selection circuit selecting an output channel used to output the signal from the plurality of output channels in accordance with a preset number of channels. The plurality of output channels include an effective channel selected by the output channel selection circuit and an ineffective channel other than the effective channel. When a malfunction occurs in the output buffer circuit of the effective channel, the output buffer circuit in which the malfunction occurs is automatically switched to the output buffer circuit of the ineffective channel so that the output of the signal from the effective channel is continued.

Effects of the Invention

According to the driver IC according to the present invention, the output buffer circuit of the ineffective channel can be used as an output buffer circuit for backup, so that reliability of the driver IC can be enhanced.

PREFERRED EMBODIMENTS FOR IMPLEMENTING THE INVENTION

Embodiment 1

Figure 1:
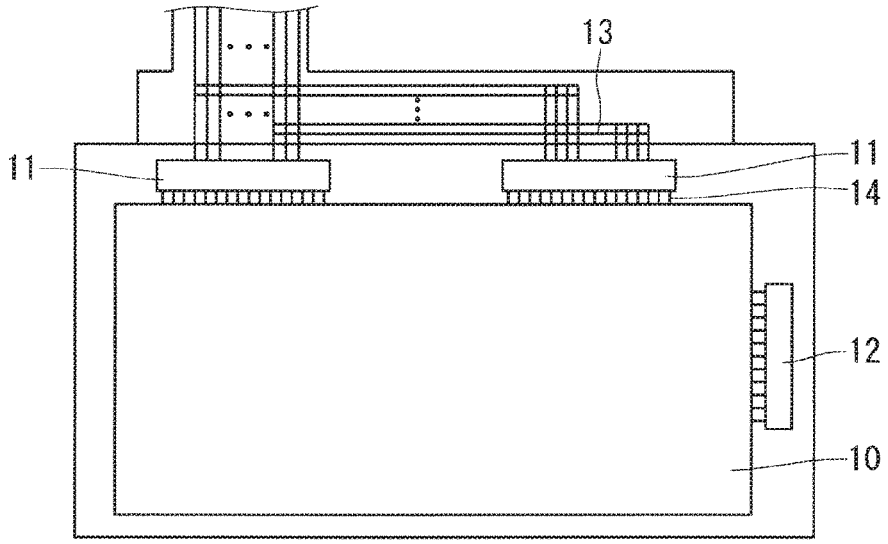
FIG. 1 is a view illustrating a configuration of a liquid crystal display apparatus according to an embodiment 1.

FIG. 1 is a view illustrating a configuration of a liquid crystal display apparatus according to the present embodiment 1. The liquid crystal display apparatus includes a liquid crystal display panel 10 and a plurality of driver ICs. The driver IC includes a source driver IC 11 for driving source signal lines (column direction wirings) of the liquid crystal display panel 10 and a gate driver IC 12 for driving gate signal lines (row direction wirings) of the liquid crystal display panel 10.

In the present embodiment 1, a configuration of the source driver IC 11 as the driver IC is described. The source driver IC 11 is referred to simply as the driver IC 11 hereinafter. FIG. 1 illustrates the configuration that the two driver ICs 11 are disposed, however, the number of driver ICs 11 is not limited thereto.

Input from an input signal unit 13 to the driver IC 11 are, for example, a control signal, an image signal which is a digital signal, an analog voltage which becomes a base at time of being applied to a panel pixel. An output signal is input from the driver IC 11 to each source signal line of the liquid crystal display panel 10 via an output signal unit 14.

Figure 2:
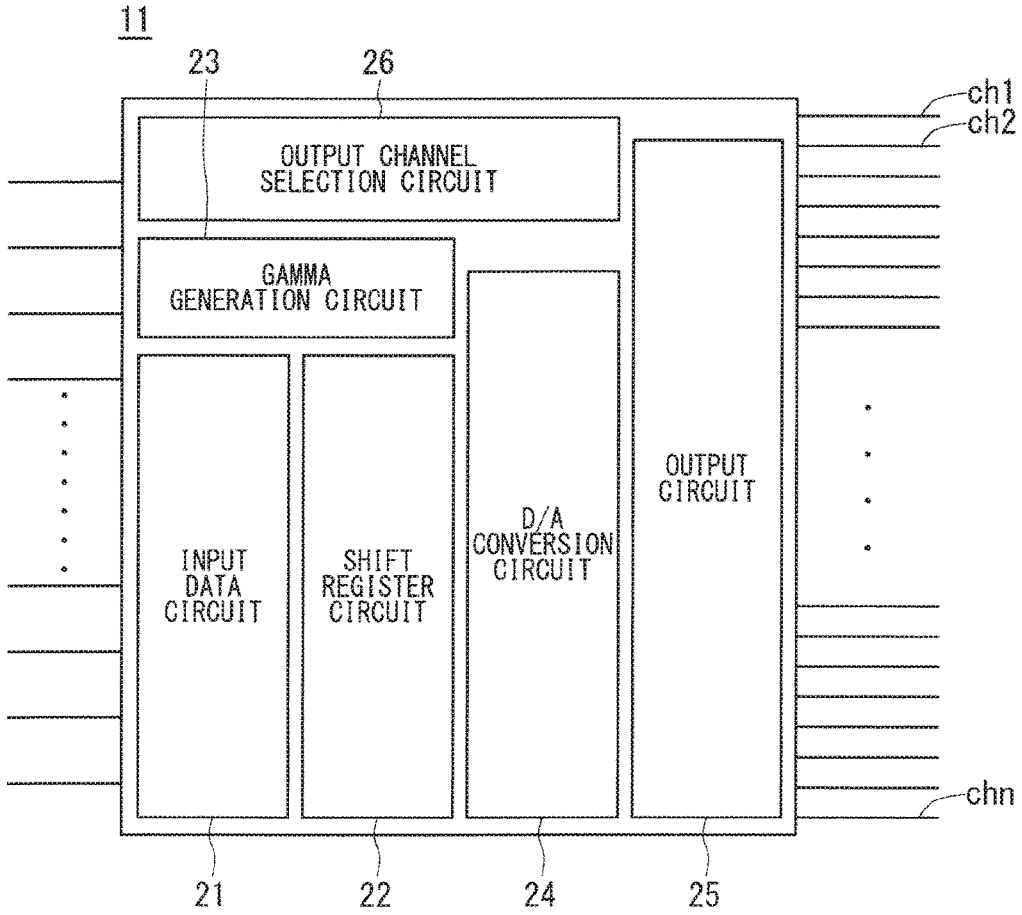
FIG. 2 is a block diagram of a driver IC according to the embodiment 1.

FIG. 2 is a block diagram of the driver IC 11 according to the present embodiment 1. As shown in FIG. 2, the driver IC 11 includes an input data circuit 21, a shift register circuit 22, a gamma generation circuit 23, a D/A conversion circuit 24, an output circuit 25, and an output channel selection circuit 26.

Input to the input data circuit 21 are, for example, a control signal, an image signal which is a digital signal, an analog voltage which becomes a reference voltage at time of being applied to a panel pixel. The gamma generation circuit 23 corrects the image signal so that the image signal can recreate a desired tone in the liquid crystal display panel 10. The D/A conversion circuit 24 is provided in a front stage of the output circuit and converts the image signal from a digital signal to an analog signal.

The output circuit 25 includes the same number of output buffer circuits as output channels ch1 to chn. The output channel selection circuit 26 allocates, using the output channel selection function, each of the output channels ch1 to chn to an effective channel or an ineffective channel. The effective channel is used to drive the liquid crystal display panel 10. The ineffective channel is used as a backup of the effective channel at time of occurrence of malfunction in the effective channel.

The input data circuit 21, the shift register circuit 22, the gamma generation circuit 23, the D/A conversion circuit 24, the output circuit 25, and the output channel selection circuit 26 may be a dedicated hardware (a processing circuit) or a CPU (Central Processing Unit: also referred to as a central processor, a processing device, a calculation device, a microprocessor, a microcomputer, a processor, or a DSP) for executing a program stored in a memory not shown in the drawings.

When the input data circuit 21, the shift register circuit 22, the gamma generation circuit 23, the D/A conversion circuit 24, the output circuit 25, and the output channel selection circuit 26 are the hardware, a single circuit, a combined circuit, a programmed processor, a parallel-programmed processor, an ASIC, a FPGA, or those combination, for example, fall under these circuits.

When the input data circuit 21, the shift register circuit 22, the gamma generation circuit 23, the D/A conversion circuit 24, the output circuit 25, and the output channel selection circuit 26 are the CPU, these functions are achieved by a software, a firmware, or a combination of the software and the firmware. The software and the firmware are described as a program and stored in a memory. The input data circuit 21, the shift register circuit 22, the gamma generation circuit 23, the D/A conversion circuit 24, the output circuit 25, and the output channel selection circuit 26 read out and execute the program stored in the memory, thereby achieving the function. This program is also deemed to cause the computer to execute a procedure or a method of the input data circuit 21, the shift register circuit 22, the gamma generation circuit 23, the D/A conversion circuit 24, the output circuit 25, and the output channel selection circuit 26. Herein, a non-volatile or volatile semiconductor memory such as a RAM, a ROM, a flash memory, an EPROM, and EEPROM, a magnetic disc, a flexible disc, an optical disc, a compact disc, a mini disc, and a DVD, for example, fall under the memory.

It is also applicable to achieve, using the dedicated hardware, part of the functions of the input data circuit 21, the shift register circuit 22, the gamma generation circuit 23, the D/A conversion circuit 24, the output circuit 25, and the output channel selection circuit 26 and achieve part of the functions using the software or the firmware.

Figure 3:
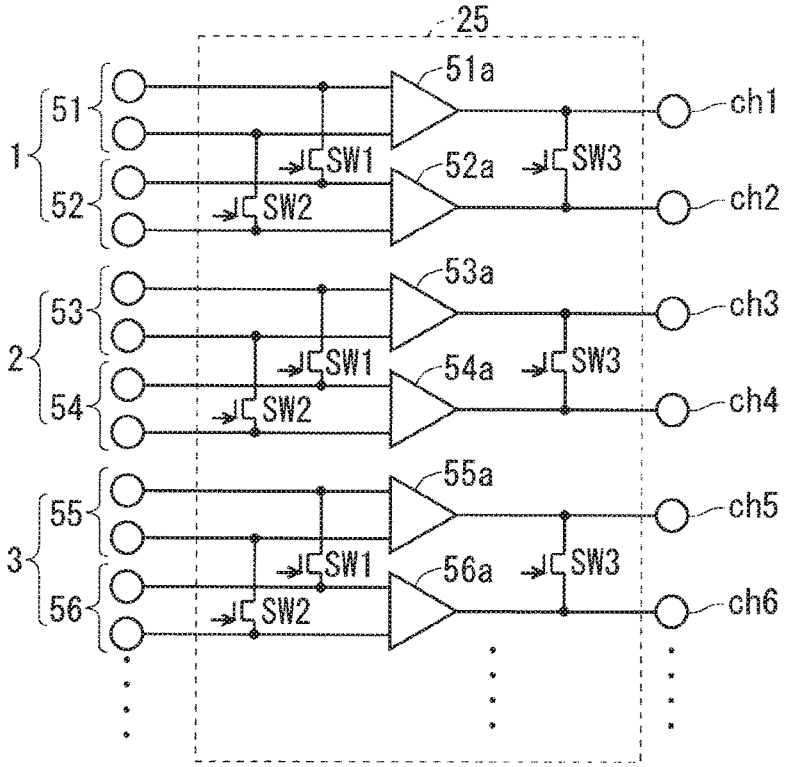
FIG. 3 is a view illustrating a configuration of an output circuit according to the embodiment 1.

FIG. 3 is a view illustrating a circuit configuration of the output circuit 25. The output circuit 25 includes output buffer circuits 51 to 56 corresponding to each of the output channels ch1 to ch6. Only six output buffer circuits are illustrated in FIG. 3 for enhancing visibility of the drawing. The output buffer circuits 51 to 56 are circuits including operational amplifiers 51*a* to 56*a*, respectively.

The output buffer circuits 51 and 52 are collectively referred to as a pair 1. Similarly, output buffer circuits 53 and 54 are collectively referred to as a pair 2, and the output buffer circuits 55 and 56 are collectively referred to as a pair 3.

In the pair 1, the output buffer circuit 52 can also function as a backup circuit at the time of occurrence of the malfunction in the output buffer circuit 51 in addition to outputting the image signal in a manner similar to the output buffer circuit 51. In the pair 1, each of input sides and output sides of the output buffer circuits 51 and 52 are connected to each other via switches SW1, SW2, and SW3. The pairs 2 and 3 also have the similar configuration.

The output channel selection circuit 26 selects the output channel used to output the signal (that is to say, the effective channel) from the plurality of output channels ch1 to ch6 in accordance with a preset number of channels. That is to say, all of the output channels ch1 to chn are allocated to the effective channel or the ineffective channel by the output channel selection circuit 26. In other words, all of the output buffer circuits 51 to 56 are separated into the effective output buffer circuit and the ineffective output buffer circuit by the output channel selection circuit 26.

When the output buffer circuit 52 of the pair 1 is allocated to the effective channel, for example, the output channel selection circuit 26 outputs the control signal for causing the switches SW1, SW2, and SW3 in the pair 1 to be off (enter a non-conductive state) to those switches.

In contrast, when the output buffer circuit 52 of the pair 1 is not allocated to the effective channel (that is to say, when allocated to the ineffective channel), for example, the output channel selection circuit 26 outputs the control signal for causing the switches SW1, SW2, and SW3 in the pair 1 to be on (enter a conductive state) to those switches.

The output channel selection circuit 26 also performs the operation similar to the operation described above on the output buffer circuit 54 of the pair 2 and the output buffer circuit 56 of the pair 3.

Figure 4:
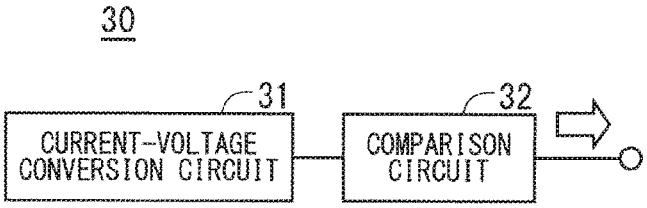
FIG. 4 is a view illustrating a configuration of a malfunction detection circuit according to the embodiment 1.
Figure 5:
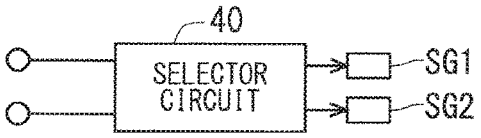
FIG. 5 is a view illustrating a configuration of a switch circuit according to the embodiment 1.

In the driver IC 11 of the present embodiment 1, each of the pairs 1 to 3 of the output buffer circuit includes a malfunction detection circuit 30 and a selector circuit 40. FIG. 4 is a view illustrating a configuration of the malfunction detection circuit 30. FIG. 5 is a view illustrating a configuration of the selector circuit 40.

As shown in FIG. 4, the malfunction detection circuit 30 includes a current-voltage conversion circuit 31 and a comparison circuit 32. The current-voltage conversion circuit 31 outputs voltage in accordance with a current value being input. The comparison circuit 32 compares the input voltage with a reference voltage, and outputs a malfunction detection signal when the input voltage is excessively smaller than the reference voltage or excessively larger than the reference voltage. The selector circuit 40 shown in FIG. 5 outputs a signal SG1 and a signal SG2.

Figure 6:
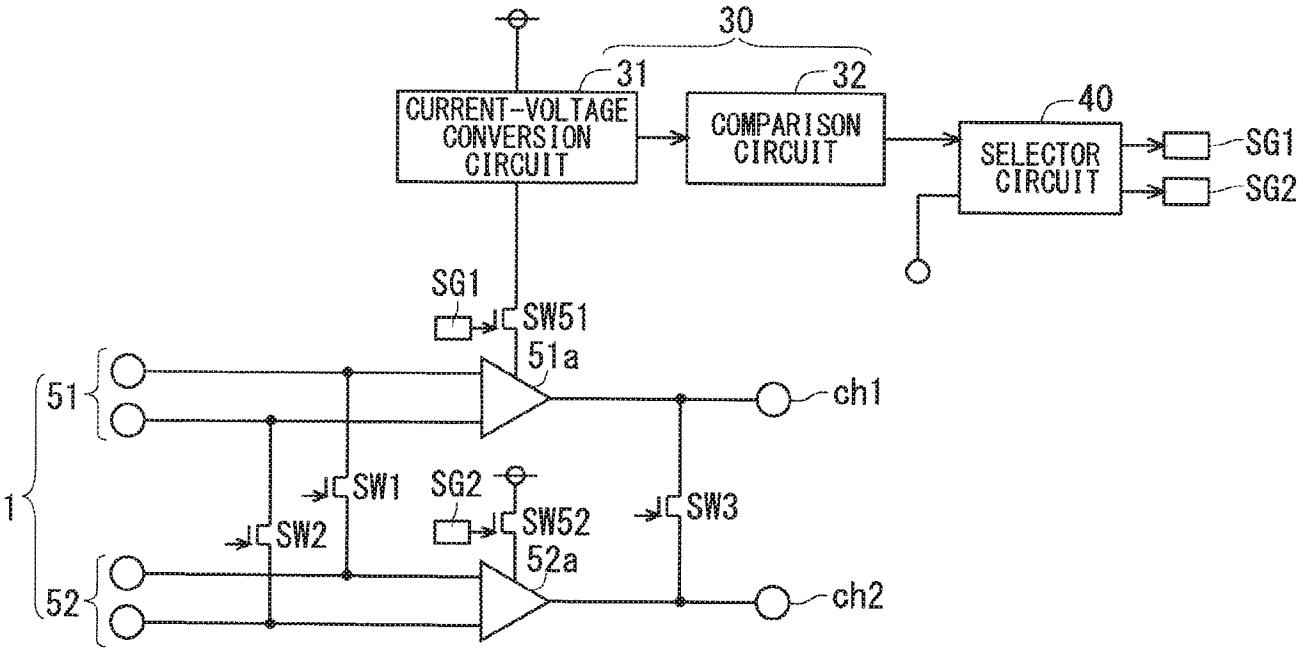
FIG. 6 is a view illustrating a connection relationship of an output buffer circuit, the malfunction detection circuit, and a selector circuit according to the embodiment 1.

FIG. 6 is a view illustrating a connection relationship of the pair 1 (the output buffer circuits 51 and 52), the malfunction detection circuit 30, and the selector circuit 40. In the present embodiment 1, the malfunction detection circuit 30 measures a consumption current of the output buffer circuit 51. The following description is based on an assumption that the output channel ch1 is the effective channel and the output channel ch2 is the ineffective channel. That is to say, the switches SW1 to SW3 are switched on in FIG. 6.

When the output buffer circuit 51 operates normally (a normal state), the selector circuit 40 outputs the on-signal as the signal SG1 and the off-signal as the signal SG2. That is to say, in the normal state, the switch SW51 is switched on in the output buffer circuit 51, so that power is supplied to the operational amplifier 51*a*. The switch SW52 is switched off in the output buffer circuit 52, so that the power is not supplied to the operational amplifier 52*a*.

When the current used in the operational amplifier 51*a* of the output buffer circuit 51 is excessively small or large, the malfunction detection circuit 30 detects the malfunction and outputs the malfunction detection signal to the selector circuit 40. Then, the selector circuit 40 outputs the off-signal as the signal SG1 and the on-signal as the signal SG2. That is to say, in the state where the malfunction is detected, the switch SW51 is switched off in the output buffer circuit 51, so that the power supply to the operational amplifier 51*a* is stopped. The switch SW52 is switched on in the output buffer circuit 52 at the same time, so that the power supply to the operational amplifier 52*a* is started. That is to say, in the malfunction detection state, the processing performed in the operational amplifier 51*a* is automatically switched to the processing in the operational amplifier 52*a*.

The operation described above enables the continuous output of the output signal from the output channel ch1 even when the malfunction occurs in the output buffer circuit 51.

The above description relates to the pair 1, however, the pairs 2 and 3 also include the malfunction detection circuit 30 and the selector circuit 40 and perform the similar operation.

Figure 7:
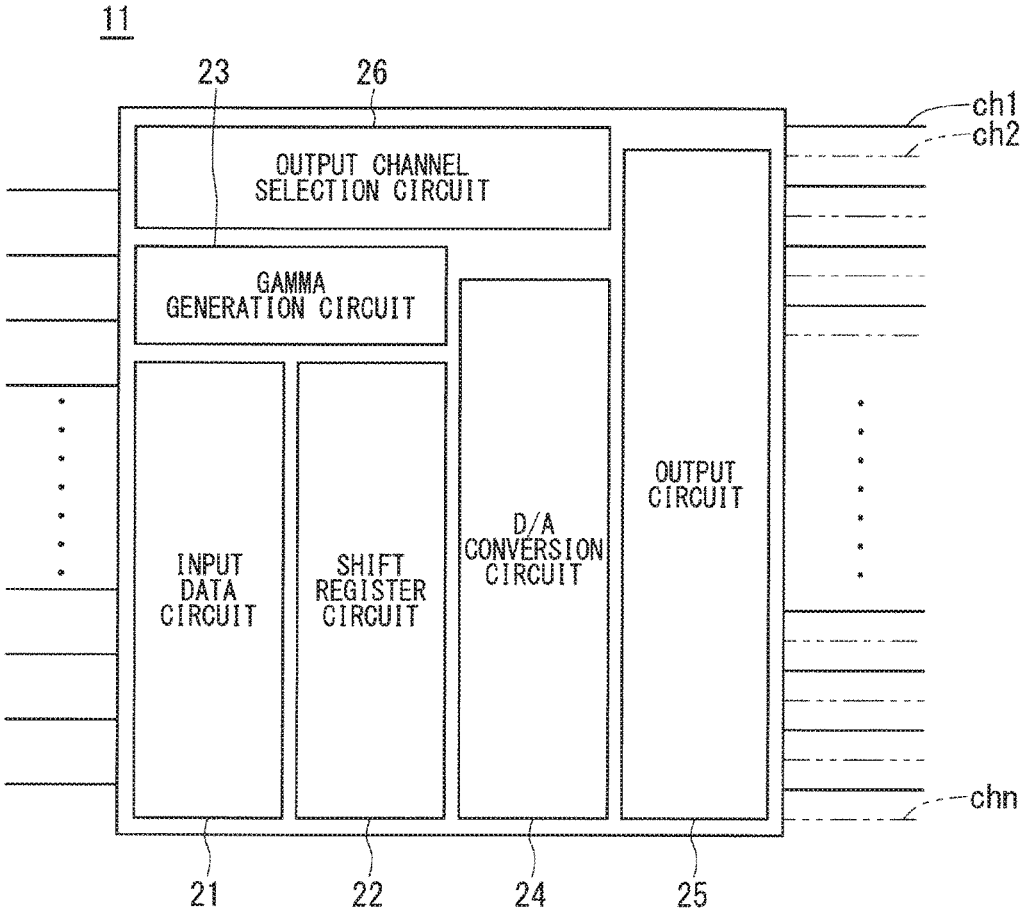
FIG. 7 is a view illustrating one example of an allocation of an effective channel and an ineffective channel in the driver IC according to the embodiment 1.
Figure 8:
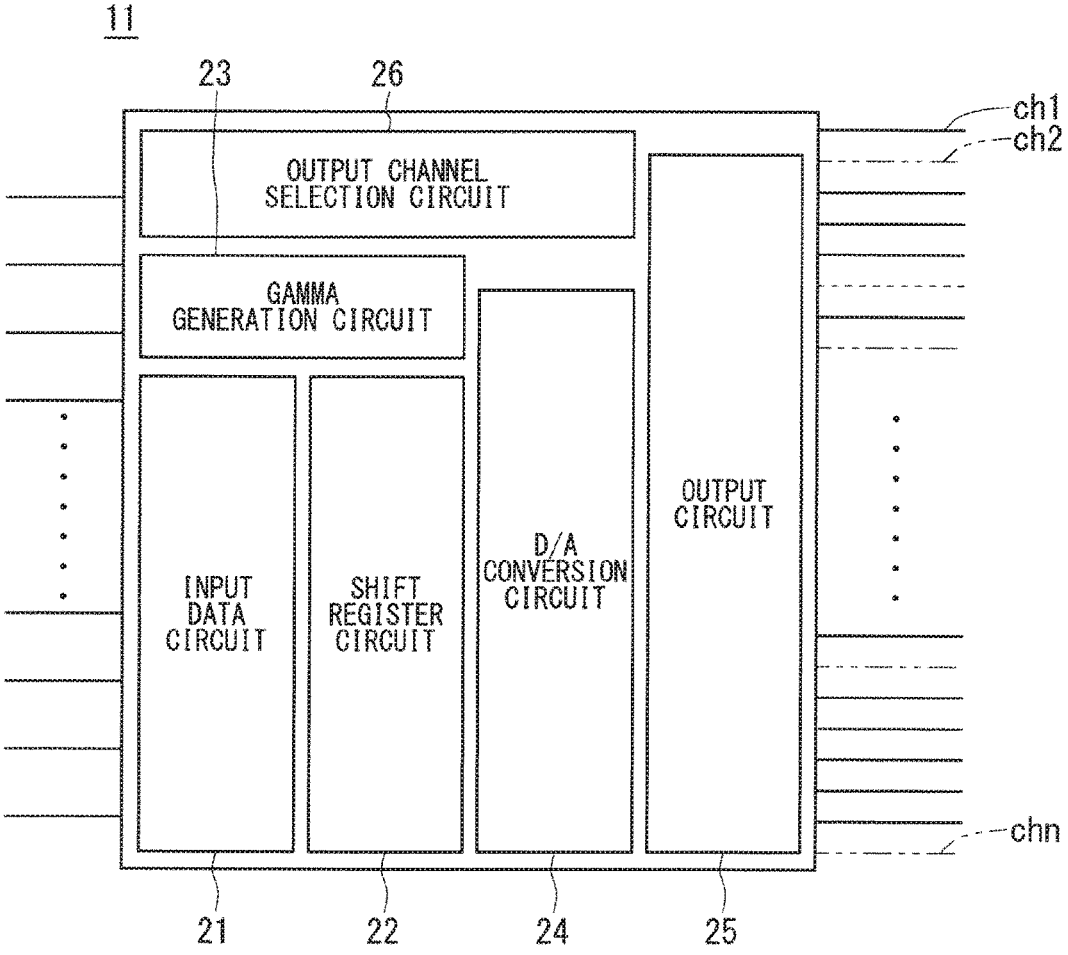
FIG. 8 is a view illustrating one example of the allocation of the effective channel and the ineffective channel in the driver IC according to the embodiment 1.
Figure 9:
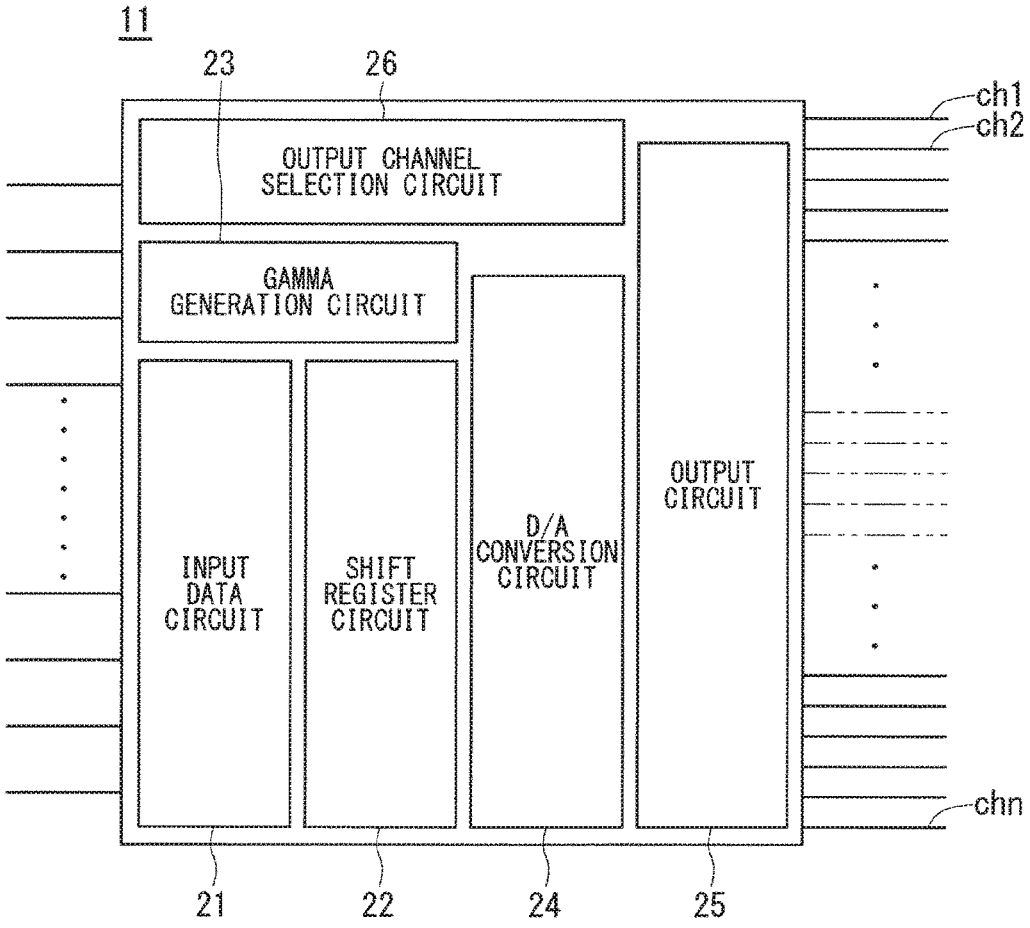
FIG. 9 is a view illustrating one example of the allocation of the effective channel and the ineffective channel in the driver IC according to the embodiment 1.

Each of FIGS. 7, 8, and 9 is a view illustrating one example of the allocation of the effective channel and the ineffective channel in the present embodiment 1. In the output channels ch1 to chn in FIGS. 7 to 9, the output channel allocated to the effective channel is indicated by a solid line, and the output channel allocated to the ineffective channel is indicated by a broken line.

As shown in FIG. 7, the output channel selection circuit 26 may alternately allocate the effective channel and the ineffective channel to the output channels ch1 to chn. As shown in FIG. 8, the output channel selection circuit 26 may allocate the effective channel and the ineffective channel to the output channels ch1 to chn at random. As shown in FIG. 9, the output channel selection circuit 26 may allocate the effective channel to both end sides of the output channels ch1 to chn and allocate the ineffective channel to a center side of the output channels ch1 to chn.

As shown in FIG. 1, the liquid crystal display apparatus may include the plurality of driver ICs 11 (that is to say, the plurality of source driver ICs 11). In the above case, it is also applicable to set one of the driver ICs 11 to a master mode and set the remaining driver ICs 11 to a slave mode. The driver IC 11 which is set to the slave mode operates in accordance with a control signal generated in the driver IC 11 which is set to the master mode. The driver IC 11 which is set to the master mode includes a timing controller. The control signal is a signal generated in the timing controller.

The operation of switching the output buffer circuit of the effective channel in which the malfunction is detected to the output buffer circuit of the ineffective channel is performed regardless of whether or not the driver IC 11 is set to the master mode or the slave mode. That is to say, the operation of switching the output buffer circuit of the effective channel in which the malfunction is detected to the output buffer circuit of the ineffective channel can be performed whichever mode, that is to say, the master mode and the slave mode, the driver IC 11 is set to.

Effect

The driver IC 11 according to the present embodiment 1 is used to drive the liquid crystal display panel 10. The driver IC 11 includes the plurality of output channels ch1 to chn outputting signals to each of the plurality of row wirings or plurality of column wirings in the liquid crystal display panel 10, the plurality of output buffer circuits 51 to 56 corresponding to each of the plurality of output channels ch1 to chn, and the output channel selection circuit 26 selecting the output channel used to output the signal from the plurality of output channels ch1 to chn in accordance with the preset number of channels, wherein the plurality of output channels ch1 to chn include the effective channel selected by the output channel selection circuit 26 and the ineffective channel other than the effective channel, and when the malfunction occurs in the output buffer circuit of the effective channel, the output buffer circuit in which the malfunction occurs is automatically switched to the output buffer circuit of the ineffective channel so that the output of the signal from the effective channel is continued.

In the driver IC according to the present embodiment 1, when the malfunction occurs in the output buffer circuit of the effective channel, the output buffer circuit in which the malfunction occurs is automatically switched to the output buffer circuit of the ineffective channel so that the output of the signal from the effective channel is continued. Accordingly, the backup (Fail-Safe) using the unused output buffer circuit (the ineffective channel) can be achieved, so that reliability in the driver IC can be enhanced.

The driver IC 11 according to the present embodiment 1 further includes the malfunction detection circuit 30 detecting the malfunction of the output buffer circuit and the selector circuit 40, and when the malfunction detection circuit 30 detects the malfunction of the output buffer circuit of the effective channel, the selector circuit 40 switches the output buffer circuit in which the malfunction is detected to the output buffer circuit of the ineffective channel.

Accordingly, the malfunction detection circuit 30 and the selector circuit 40 are provided in the driver IC 11, so that the output buffer circuit in which the malfunction is detected can be switched to the output buffer circuit of the ineffective channel.

In the driver IC 11 according to the present embodiment 1, the malfunction detection circuit 30 detects the malfunction of the output buffer circuit based on the current consumed by the output buffer circuit.

When the malfunction occurs in the output buffer circuit, the consumption current of the output buffer circuit may be excessively small or large. Accordingly, the malfunction detection circuit 30 can effectively detect the malfunction of the output buffer circuit.

The liquid crystal display apparatus according to the present embodiment 1 includes the driver IC 11 and the liquid crystal display panel 10 driven by the driver IC 11. In the driver IC 11 according to the present embodiment 1, the output buffer circuit in which the malfunction occurs can be backed up by the unused output buffer circuit (the ineffective channel). Accordingly, even when the malfunction occurs in the output buffer circuit, a high-quality image can be continuously displayed in the liquid crystal display apparatus.

The liquid crystal display apparatus according to the present embodiment 1 includes the plurality of driver ICs 11 and a liquid crystal display panel 10 driven by the driver IC 11. One of the plurality of driver ICs 11 is set to the master mode, and the other driver ICs 11 are set to the slave mode. The driver ICs 11 which are set to the slave mode operate in accordance with the control signal generated in the driver IC 11 which is set to the master mode, and in each of the plurality of driver ICs 11, the operation of switching the output buffer circuit in which the malfunction is detected to the output buffer circuit of the ineffective channel is performed regardless of whether the driver IC 11 is set to the master mode or the slave mode.

Accordingly, even when the liquid crystal display panel 10 is driven by the plurality of driver ICs 11 using the setting of the master mode and the slave mode, the output buffer circuit in which the malfunction occurs can be backed up (Fail-Safe) by the unused output buffer circuit (the ineffective channel).

Embodiment 2

Figure 10:
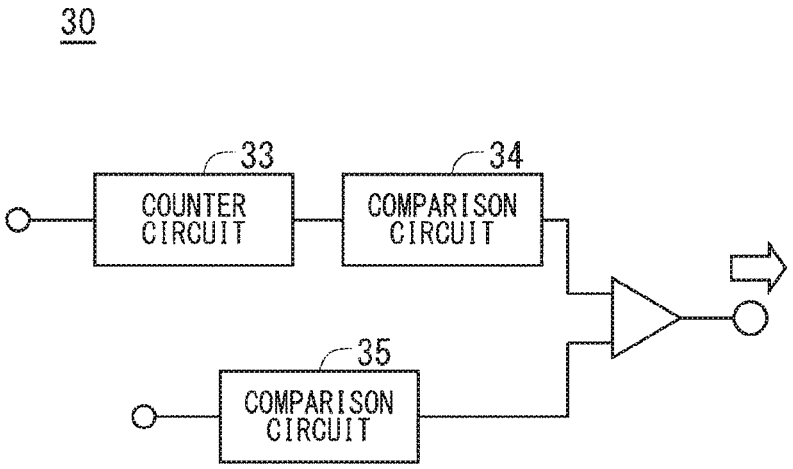
FIG. 10 is a view illustrating a configuration of a malfunction detection circuit according to an embodiment 2.
Figure 11:
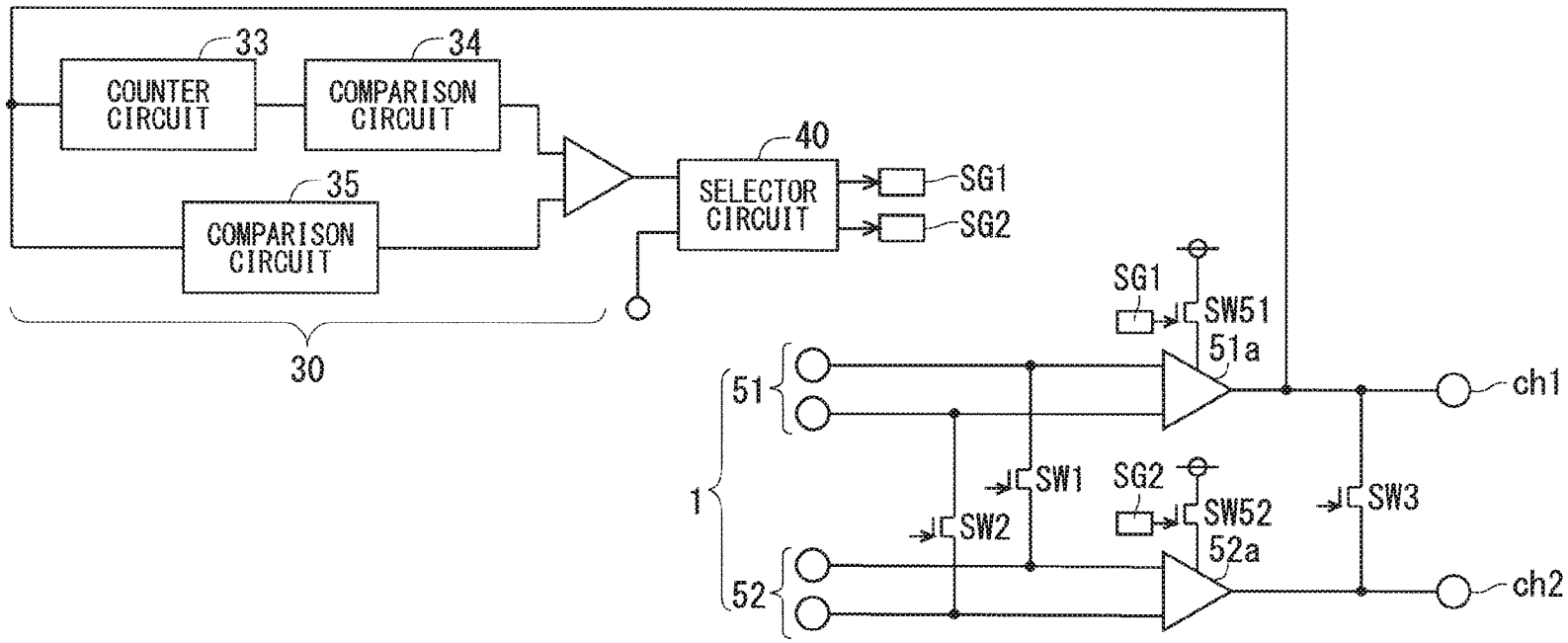
FIG. 11 is a view illustrating a connection relationship of an output buffer circuit, the malfunction detection circuit, and a selector circuit according to the embodiment 2.

FIG. 10 is a view illustrating a configuration of the malfunction detection circuit 30 according to the present embodiment 2. FIG. 11 is a view illustrating a connection relationship of the pair 1 (the output buffer circuits 51 and 52), the malfunction detection circuit 30, and the selector circuit 40 according to the present embodiment 2. A configuration according to the present embodiment 2 except for the malfunction detection circuit 30 is the same as that of the embodiment 1, so that the description is omitted.

As shown in FIG. 10, the malfunction detection circuit 30 includes a counter circuit 33 and a comparison circuit 34. The output signal of the output buffer circuit 51 is input to the counter circuit 33. The counter circuit 33 counts a cycle of the output signal (that is to say, a pulse of the output signal). The comparison circuit 32 compares the counted number of pulses with a reference number of pulses, and outputs the malfunction detection signal when the counted number of pulses is excessively smaller than the reference number of pulses or excessively larger than the reference number of pulses.

As shown in FIG. 10, the malfunction detection circuit 30 includes a comparison circuit 35. The output signal of the output buffer circuit 51 is input to the comparison circuit 35. The comparison circuit 35 compares a voltage level of the output signal with a reference voltage, and outputs the malfunction detection signal when the voltage level of the output signal is excessively smaller than the reference voltage or excessively larger than the reference voltage. The operation of the selector circuit 40 to which the malfunction detection signal is input is the same as that of the embodiment 1, so that the description is omitted.

Effect

In the driver IC 11 according to the present embodiment 2, the malfunction detection circuit 30 detects the malfunction of the output buffer circuit based on the voltage level of the signal being output by the output buffer circuit.

When the malfunction occurs in the output buffer circuit, the voltage level of the output buffer circuit may be excessively small or large. Accordingly, the malfunction detection circuit 30 can effectively detect the malfunction of the output buffer circuit.

In the driver IC 11 according to the present embodiment 2, the malfunction detection circuit 30 detects the malfunction of the output buffer circuit based on the cycle of the signal being output by the output buffer circuit.

When the malfunction occurs in the output buffer circuit, the cycle of the output signal of the output buffer circuit may deviate from the reference cycle. Accordingly, the malfunction detection circuit 30 can effectively detect the malfunction of the output buffer circuit.

Embodiment 3

Figure 12:
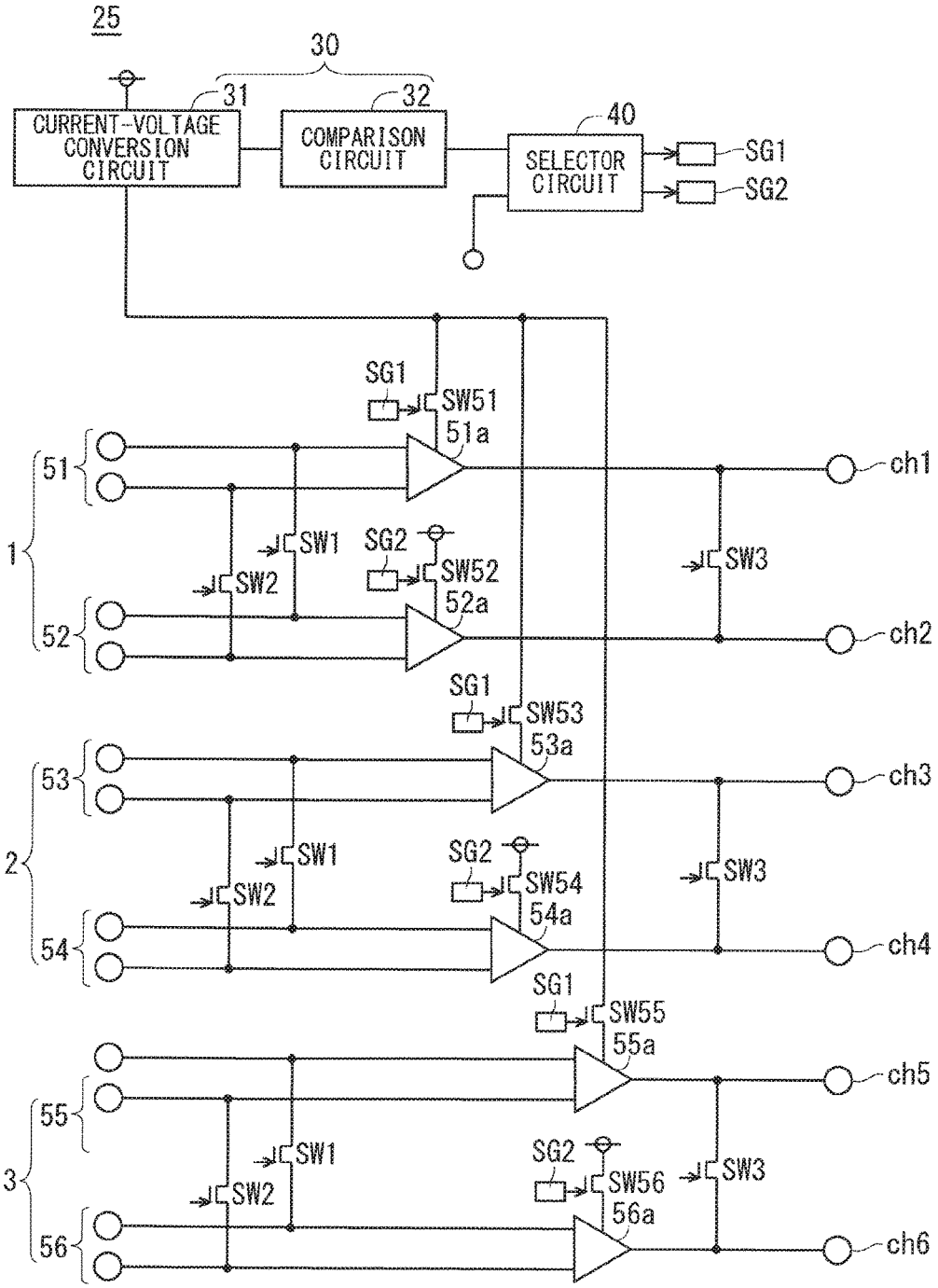
FIG. 12 is a view illustrating a connection relationship of an output buffer circuit, a malfunction detection circuit, and a selector circuit according to an embodiment 3.

FIG. 12 is a view illustrating a connection relationship of the output buffer circuits 51 to 56 of the pairs 1 to 3, the malfunction detection circuit 30, and the selector circuit 40 according to the present embodiment 3. In the present embodiment 3, the malfunction detection circuit 30 and the selector circuit 40 are shared among the pairs 1 to 3.

The description of the present embodiment 3 is based on an assumption that the output channels ch1, ch3, and ch5 are the effective channels and the output channels ch2, ch4, and ch6 are the ineffective channels. That is to say, the switches SW1 to SW3 are switched on in each of the pairs 1 to 3.

As shown in FIG. 12, the malfunction detection circuit 30 measures a sum of the consumption current of the output buffer circuits 51, 53, and 55.

In the state where all of the output buffer circuits 51, 53, and 55 operate normally (the normal state), the selector circuit 40 outputs the on-signal as the signal SG1 and the off-signal as the signal SG2. That is to say, in the normal state, the switches SW51, SW53, and SW55 are switched on in the output buffer circuits 51, 53, and 55, respectively, so that the power is supplied to the operational amplifiers 51*a*, 53*a*, and 55*a*. The switches SW52, SW54, and SW56 are switched off in the output buffer circuits 52, 54, and 56, respectively, so that the power is not supplied to the operational amplifiers 52*a*, 54*a*, and 56*a*.

When the sum of the current used in the operational amplifiers 51*a*, 53*a*, and 55*a* of the output buffer circuits 51, 53, and 55 is excessively small or large, the malfunction detection circuit 30 detects the malfunction and outputs the malfunction detection signal to the selector circuit 40. Then, the selector circuit 40 outputs the off-signal as the signal SG1 and the on-signal as the signal SG2. That is to say, in the malfunction detection state, the switches SW51, SW53, and SW55 are switched off in the output buffer circuits 51, 53, and 55, respectively, so that the power supply to the operational amplifiers 51*a*, 53*a*, and 55*a* is stopped. At the same time, the switches SW52, SW54, and SW56 are switched on in the output buffer circuits 52, 54, and 56, respectively, so that the power supply to the operational amplifiers 52*a*, 54*a*, and 56*a* is started. That is to say, in the malfunction detection state, the processing performed in the operational amplifiers 51*a*, 53*a*, and 55*a* is automatically switched to the processing in the operational amplifiers 52*a*, 54*a*, and 56*a*, respectively.

The operation described above enables the continuous output of the output signal from the output channels ch1, ch3, and ch5 even when the malfunction occurs in the output buffer circuits 51, 53, and 55, respectively.

Effect

In the driver IC 11 according to the present embodiment 3, the malfunction detection circuit 30 is shared among the plurality of output buffer circuits 51 to 56. Accordingly, in the present embodiment 3, the number of malfunction detection circuits 30 can be reduced compared with the case where the malfunction detection circuit 30 is provided for each of the pairs 1 to 3 of the output buffer circuit. According to the above configuration, the enlargement of the circuit size of the driver IC 11 can be suppressed.

According to the present invention, the above embodiments can be arbitrarily combined, or each embodiment can be appropriately varied or omitted within the scope of the invention.

The invention claimed is:

1. A driver IC used to drive a liquid crystal display panel, comprising:

a plurality of output channels outputting signals to each of a plurality of row wirings or plurality of column wirings in said liquid crystal display panel;

a plurality of output buffer circuits corresponding to each of said plurality of output channels; and an output channel selection circuit selecting an output channel used to output a signal from said plurality of output channels in accordance with a preset number of channels, wherein said plurality of output buffer circuits comprise a plurality of pairs of two output buffer circuits, each of said plurality of pairs being connected to a corresponding output channel, said plurality of output channels include:

a plurality of effective channels selected by said output channel selection circuit; and a plurality of ineffective channels configured to be controlled by the same output channel selection circuit as the plurality of effective channels, one of said two output buffer circuits of each pair of said plurality of pairs is assigned to an effective channel of said plurality of effective channels and the other is assigned to an ineffective channel of said plurality of ineffective channels, when a malfunction has not occurred in said output buffer circuit that is assigned to said effective channel, said output buffer circuit assigned to said ineffective channel is non-operational, and when a malfunction has occurred in said output buffer circuit that is assigned to said effective channel, said output buffer circuit that is assigned to said ineffective channel is switched as a back-up circuit for said output buffer circuit in which said malfunction occurs, thereby continuing output of signals from said effective channel.

2. The driver IC according to claim 1, further comprising:

a malfunction detection circuit detecting a malfunction of said output buffer circuit; and a selector circuit, wherein when said malfunction detection circuit detects a malfunction of said output buffer circuit of said effective channel, said selector circuit switches said output buffer circuit in which said malfunction is detected to said output buffer circuit of said ineffective channel.

3. The driver IC according to claim 2, wherein said malfunction detection circuit detects a malfunction of said output buffer circuit based on a current consumed by said output buffer circuit.

4. The driver IC according to claim 3, wherein said malfunction detection circuit is shared among said plurality of output buffer circuits.

5. The driver IC according to claim 2, wherein said malfunction detection circuit detects a malfunction of said output buffer circuit based on a voltage level of a signal being output by said output buffer circuit.

6. The driver IC according to claim 5, wherein said malfunction detection circuit is shared among said plurality of output buffer circuits.

7. The driver IC according to claim 2, wherein said malfunction detection circuit detects a malfunction of said output buffer circuit based on a cycle of a signal being output by said output buffer circuit.

8. The driver IC according to claim 7, wherein said malfunction detection circuit is shared among said plurality of output buffer circuits.

9. The driver IC according to claim 2, wherein said malfunction detection circuit is shared among said plurality of output buffer circuits.

10. A liquid crystal display apparatus, comprising:

a driver IC according to claim 1; and a liquid crystal display panel driven by said driver IC.

11. A liquid crystal display apparatus, comprising:

a plurality of driver ICs according to claim 1; and a liquid crystal display panel driven by said driver ICs, wherein one of said plurality of driver ICs is set to a master mode, and other driver ICs are set to a slave mode, said driver ICs which are set to said slave mode operate in accordance with a control signal generated in said driver IC which is set to said master mode, and in each of said plurality of driver ICs, an operation of switching said output buffer circuit in which a malfunction is detected to said output buffer circuit of said ineffective channel is performed regardless of whether said driver IC is set to said master mode or said slave mode.

* * * * *